US008012110B2

(12) United States Patent
Chen

(10) Patent No.: US 8,012,110 B2
(45) Date of Patent: Sep. 6, 2011

(54) ANGULAR ADJUSTING MECHANISM FOR USE IN MASSAGE DEVICE OF MASSAGE MACHINE

(76) Inventor: Ko-Po Chen, Ta-Li (TW)

( * ) Notice: Subject to any disclaimer, the term of this patent is extended or adjusted under 35 U.S.C. 154(b) by 1118 days.

(21) Appl. No.: 11/818,379

(22) Filed: Jun. 14, 2007

(65) Prior Publication Data

US 2008/0312568 A1 Dec. 18, 2008

(51) Int. Cl.
*A61H 15/00* (2006.01)

(52) U.S. Cl. ..... 601/99; 601/102; 601/103; 601/116

(58) Field of Classification Search ..... 601/90, 601/92, 94, 98, 99, 100, 101, 102, 103, 115, 601/116, 126
See application file for complete search history.

(56) References Cited

U.S. PATENT DOCUMENTS

| | | | | |
|---|---|---|---|---|
| 6,790,190 | B2 * | 9/2004 | Marcantoni | 601/99 |
| 2005/0096571 | A1 * | 5/2005 | Miki | 601/99 |
| 2007/0167887 | A1 * | 7/2007 | Tsukada et al. | 601/97 |
| 2007/0299377 | A1 * | 12/2007 | Shiraishi | 601/98 |

* cited by examiner

*Primary Examiner* — Danton DeMille
(74) *Attorney, Agent, or Firm* — Raymond Y. Chan; David and Raymond Patent Firm

(57) ABSTRACT

An angular adjusting mechanism for use in a massage device of a massage machine comprises a frame including a swing seat axially disposed thereon for pivotally rotating the angle and including upper and lower massage rollers provided thereon, and between the frame and the swing seat being defined with an angular adjusting mechanism, wherein the angular adjusting mechanism includes a bush axially fixed on the frame, the swing seat includes a driver attached thereon for urging the rotation of a screw, and another end of the screw screws with the bush; thereby during the rotation of the screw, the screw may vertically displace along the bush and actuate the swing seat to axially rotate along the frame for adjusting the swing angle and increasing the support strength of the upper and lower massage rollers.

3 Claims, 9 Drawing Sheets

ANGULAR ADJUSTING MECHANISM FOR USE IN MASSAGE DEVICE OF MASSAGE MACHINE

BACKGROUND OF THE INVENTION

1. Field of the Invention

The present invention relates to an angular adjusting mechanism for use in a massage device of a massage machine that during the rotation of a screw, the screw may vertically displace along a bush and actuate a swing seat to axially rotate along a frame for adjusting the swing angle and increasing the support strength of upper and lower massage rollers.

2. Description of the Prior Arts

Referring to FIGS. 1-3, TW Pat. No. 92211833 to Chen discloses "Massaging Device of Massaging Machine" including a rubbing mechanism and an angular adjusting mechanism, wherein a frame 11 includes front and rear rotary shafts 12, 13 disposed thereon, between which a holder 14 is couplingly disposed, wherein the front rotary shaft 12 includes a support 15 axially fixed thereon for affixing the rubber mechanism which contains a motor 21 for a driver secured on the rear end of the support 15, and the motor 21 urges a pulley set 22 to transmit a rubbing shank 23 which is pivotally provided at two ends thereof with inwardly eccentric swing arms 24, individually, each having upper and lower massage rollers 25, 26 defined at the front end thereof, and the angular adjusting mechanism involves a motor 31 for a driver, by which a pulley set 32 is driven, and the holder 14 contains an angular stem 33 axially mounted thereon, between the angular stem 33 and the pullet set 32 is defined with a worm and worm gear set, wherein a worm 34 is driven by the pulley set 32 and a worm gear 35 is fixed onto the angular stem 33 having a gear 36 disposed thereon, with which an arcuate rack 37 at the bottom of the support 15 are engaged, for actuating the support 15 to swing forward and rearward.

As shown in FIGS. 2-4, during adjusting the swing angle of the upper and lower massage rollers 25 and 26, the motor 31 may be controlled to drive the pulley set 32 to transmit the rotation of the worm 34 for actuating the rotation of the worm gear 35, such that the angular stem 33 and the gear 36 may be urged to rotate, and the gear 36 actuates the arcuate rack 37 to swing forward for actuating the support 15 to swing forward and rearward, therefore the support 15 actuates the upper and lower massage rollers 25 and 26 to cause a rearward swing, and the lower massage roller 26 extends forwardly for swinging at a proper angle, thus adjusting the swing angle of the upper and lower massage rollers 25, 26.

Referring to FIGS. 2-3, although the angular adjusting mechanism may adjust the swing angle of the upper and lower massage rollers 25 and 26, because the rubber mechanism is attached on the support 15 with which the gear 36 is engaged by way of the arcuate rack 37 and the angular stem 33, and the angular stem 33 is further engaged with the worm 34 by using the worm gear 35. In the operation of the respective components in turn, the angular adjusting mechanism makes use of the worm 34 to engage with the worm gear 35 for supporting the rubbing mechanism to stably operate and for positioning the swing of the upper and lower massage rollers 25 and 26, accordingly user may abut against the upper and lower massage rollers 25, 26, and the worm 34 and the worm gear 35 may provide the support strength. However, in the engagement status of the worm 34 and the worm gear 35, the engaging area is confined, resulting in the limitation of support strength. In addition, the angular adjusting mechanism applies the driver to urge the angular stem 33, the worm 34, the worm gear 35, the gear 36 and the arcuate rack 37, causing a complicated manufacturation and assembly.

The present invention has arisen to mitigate and/or obviate the afore-described disadvantages.

SUMMARY OF THE INVENTION

The primary object of the present invention is to provide an angular adjusting mechanism for use in a massage device of a massage machine that during the rotation of a screw, the screw may vertically displace along a bush and actuate a swing seat to axially rotate along a frame for adjusting the swing angle and increasing the support strength of upper and lower massage rollers.

Another object of the present invention is to provide an angular adjusting mechanism for use in a massage device of a massage machine that may utilize a driver to cooperate with a screw, a bush and a coupling member for supporting the respective mechanisms in a swing seat to adjust the swing position of the upper and lower massage rollers, thereby effectively decreasing the related components to simplify manufacturation and assembly.

In accordance with one aspect of the present invention, there is provided an angular adjusting mechanism for use in a massage device of a massage machine comprising a frame including a rotary shaft axially disposed thereon and having a swing seat axially mounted thereon, the swing seat includes a rubbing mechanism having upper and lower massage rollers provided therein, and between the frame and the swing seat is defined with an angular adjusting mechanism, wherein the rubbing mechanism of the swing seat includes a motor for a driver, by which a transmitting assembly is urged to transmit a rubbing shank, and at the two ends of the rubbing shank are pivotally affixed two swing arms, individually, and each of the swing arms includes upper and lower massage rollers and attached at the front end thereof. It is to be noted that the angular adjusting mechanism includes a frame having a coupling member axially fixed at the back thereof, and the coupling member includes a bush pivotally mounted at another end thereof, the swing seat includes a motor for a driver, by which a pulley set is driven to transmit a screw vertically provided on the swing seat, and another end of the screw screws with the bush for the vertical displacement along the bush.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
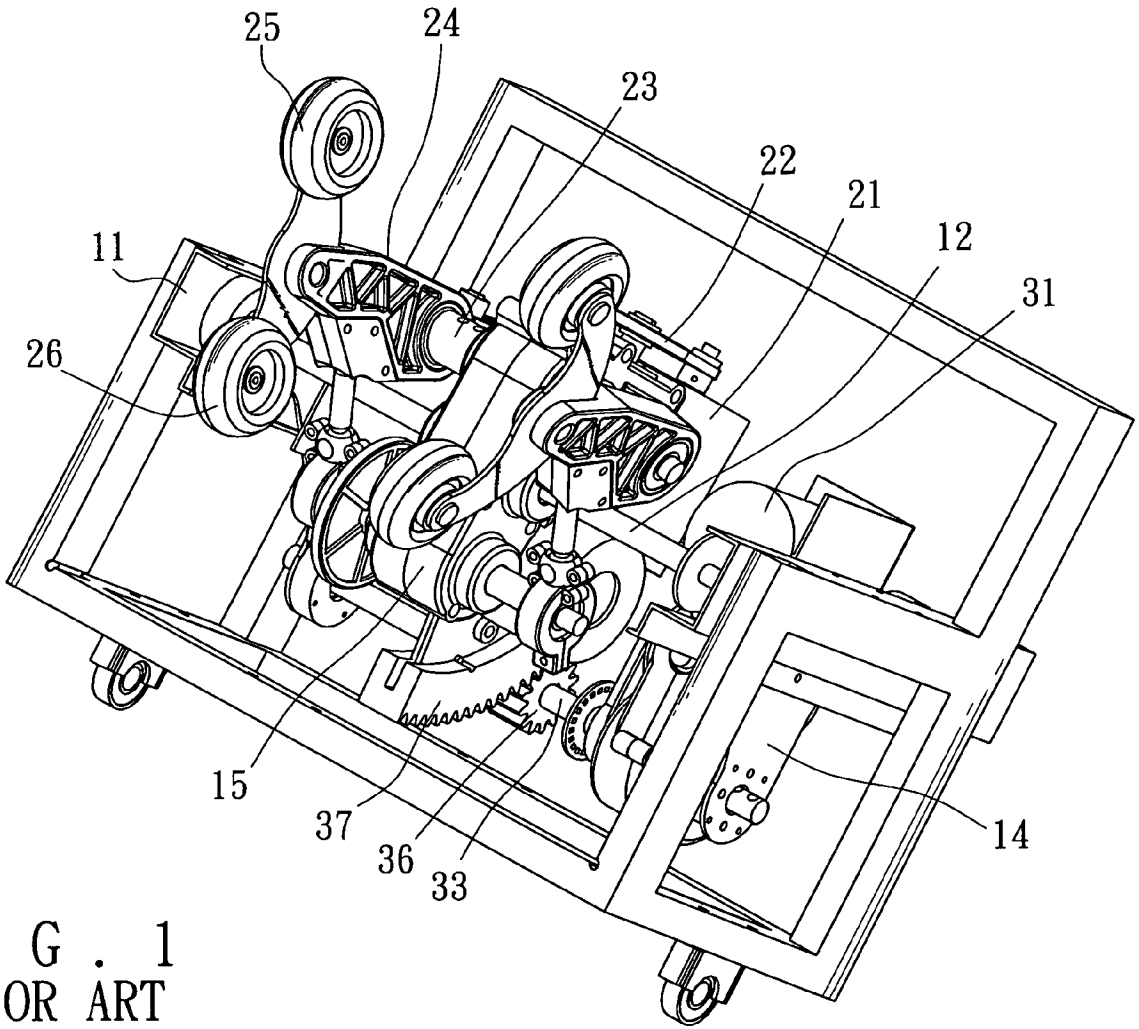
FIG. 1 PRIOR ART
FIG. 1 is a perspective diagram of a massage device of a massage machine of TW Patent No. 92211833.
Figure 2:
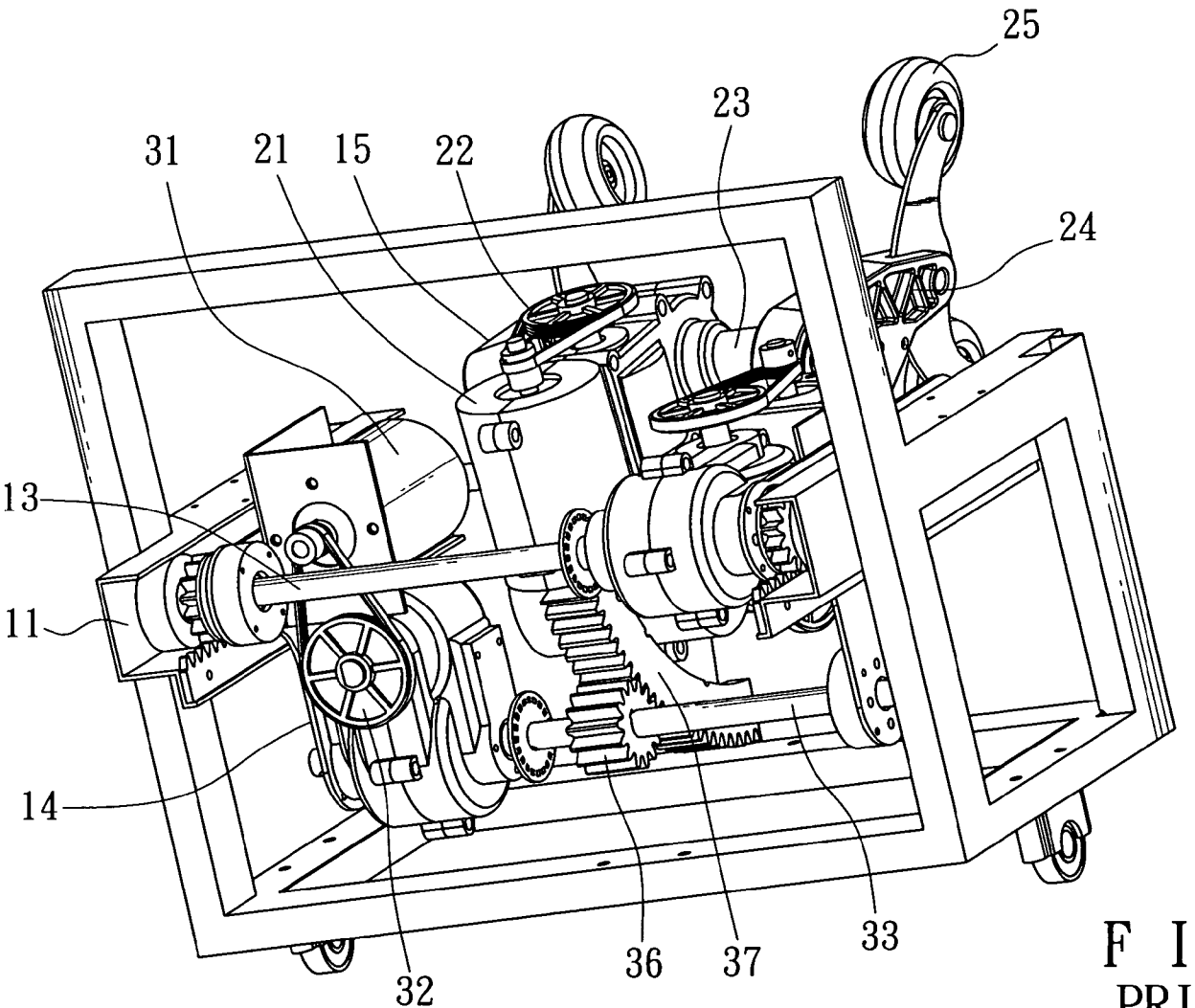
FIG. 2 PRIOR ART
FIG. 2 is another perspective diagram of the massage device of the massage machine of TW Patent No. 92211833.
Figure 3:
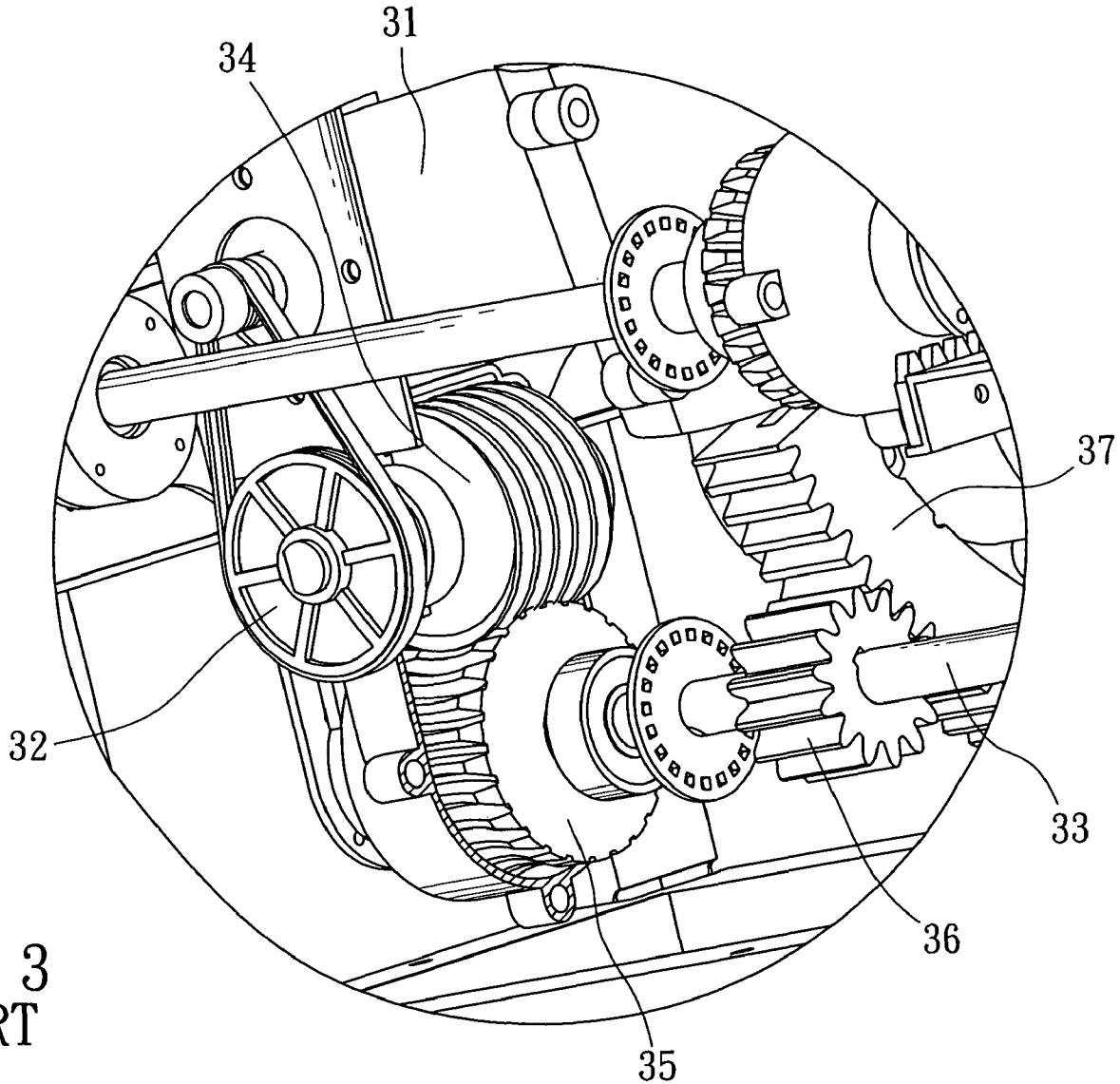
FIG. 3 PRIOR ART
FIG. 3 is a partial perspective diagram of a prior art angular adjusting mechanism.
Figure 4:
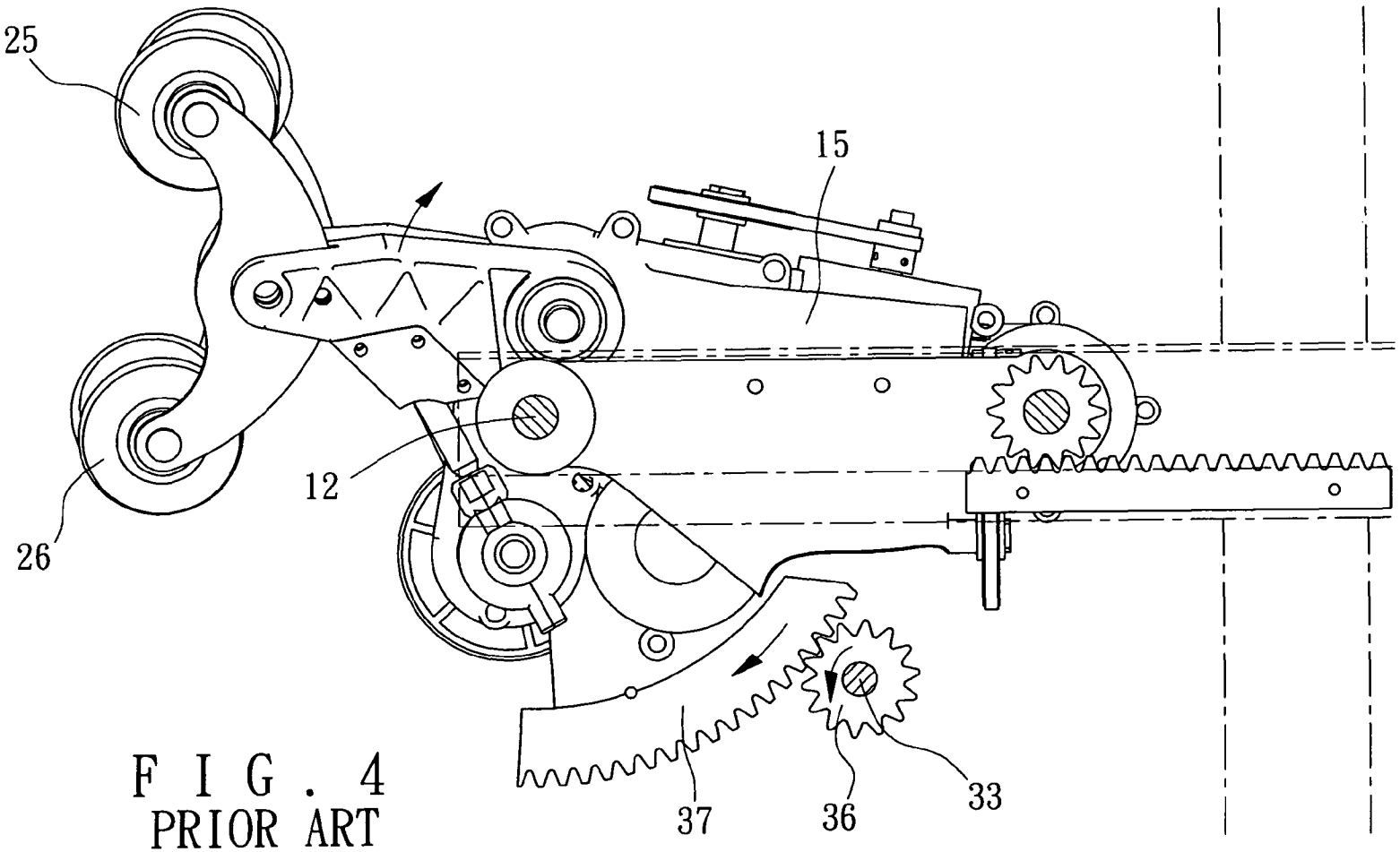
FIG. 4 PRIOR ART
FIG. 4 is a perspective diagram illustrating the operational status of the prior art angular adjusting mechanism.
Figure 5:
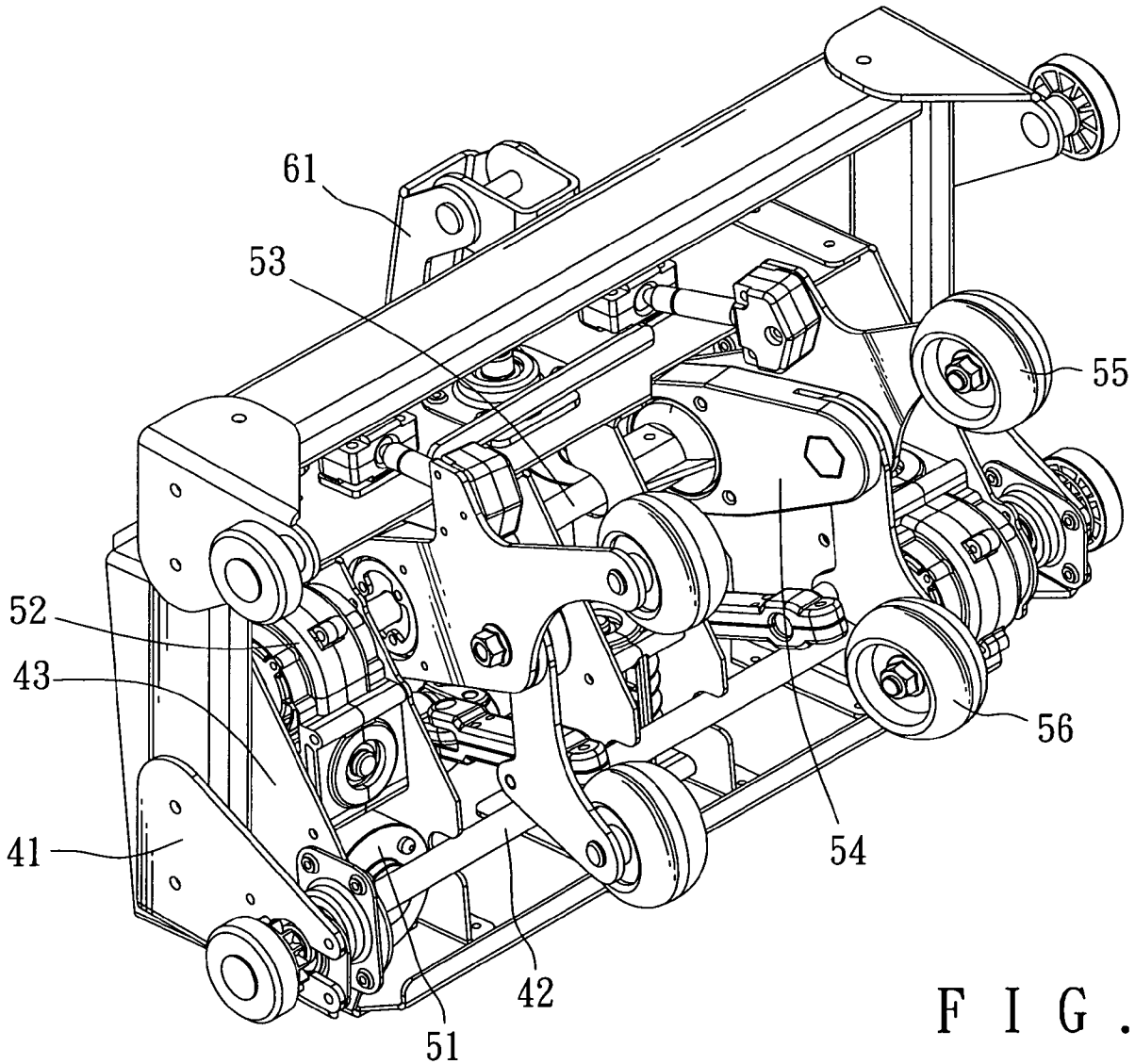
FIG. 5 is a perspective diagram of a massage machine according to the present invention.
Figure 6:
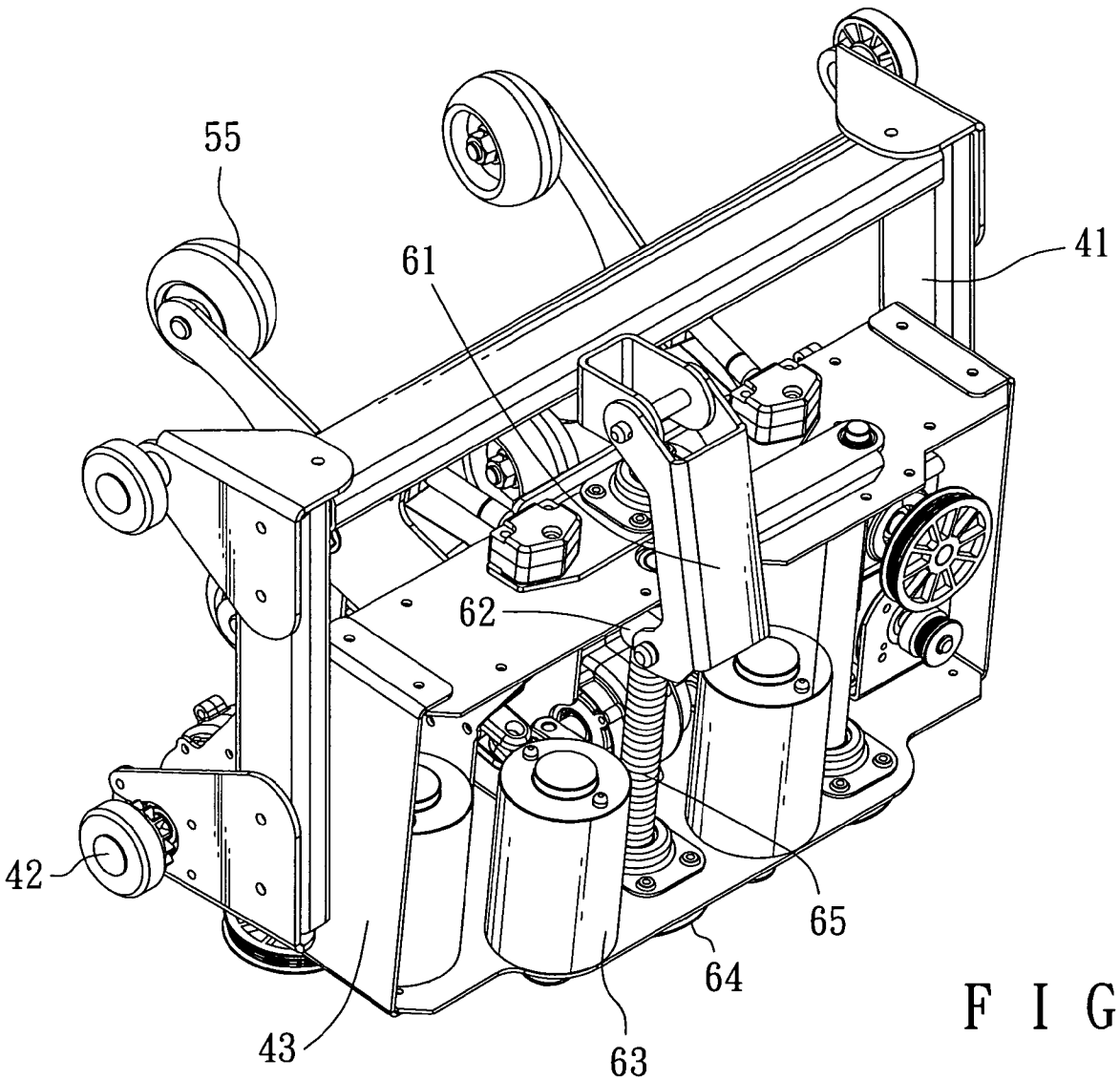
FIG. 6 is a perspective diagram of an angular adjusting mechanism according to the present invention.

Referring to FIGS. 5-8, an angular adjusting mechanism for use in a massage device of a massage machine in accordance with the present invention comprises a frame 41 including a rotary shaft 42 axially disposed thereon and having a swing seat 43 axially mounted thereon, the swing seat 43 includes a rubbing mechanism having upper and lower massage rollers provided therein, and between the frame 41 and the swing seat 43 is defined with an angular adjusting mechanism, wherein the rubbing mechanism of the swing seat 43 includes a motor 51 for a driver, by which a transmitting assembly 52 is urged to transmit a rubbing shank 53, and at the two ends of the rubbing shank 53 are pivotally affixed two swing arms 54, individually, and each of the swing arms 54 includes upper and lower massage rollers 55 and 56 attached at the front end thereof. It is to be noted that the angular adjusting mechanism includes a frame 41 having a coupling member 61 axially fixed at the back thereof, and the coupling member 61 includes a bush 62 pivotally mounted at another end thereof, the swing seat 43 includes a motor 63 for a driver, by which a pulley set 64 is driven to transmit a screw 65 vertically provided on the swing seat 43, and another end of the screw 65 screws with the bush 62 for the vertical displacement along the bush 62.

Figure 7:
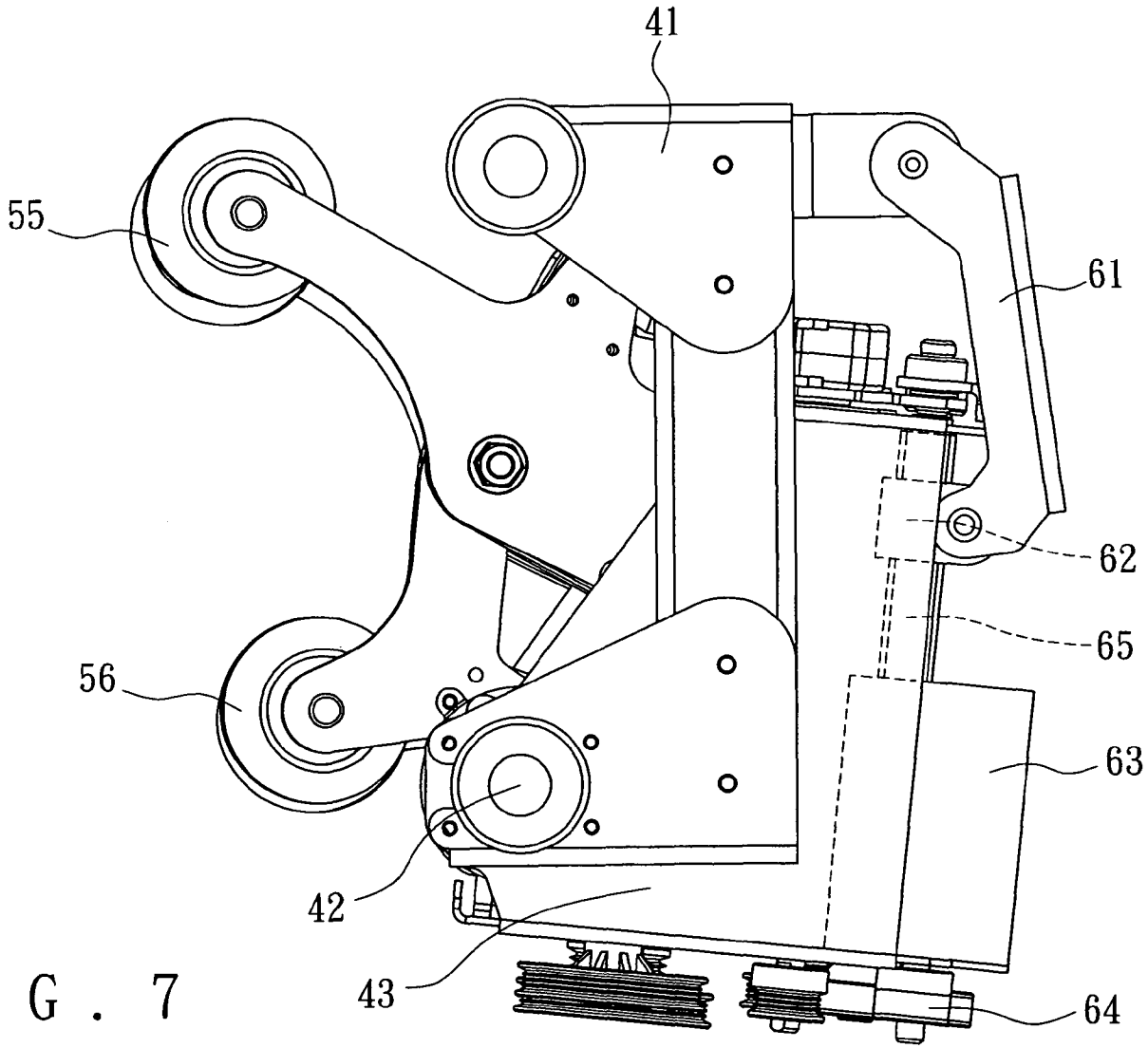
FIG. 7 is a side diagram of the angular adjusting mechanism according to the present invention.
Figure 8:
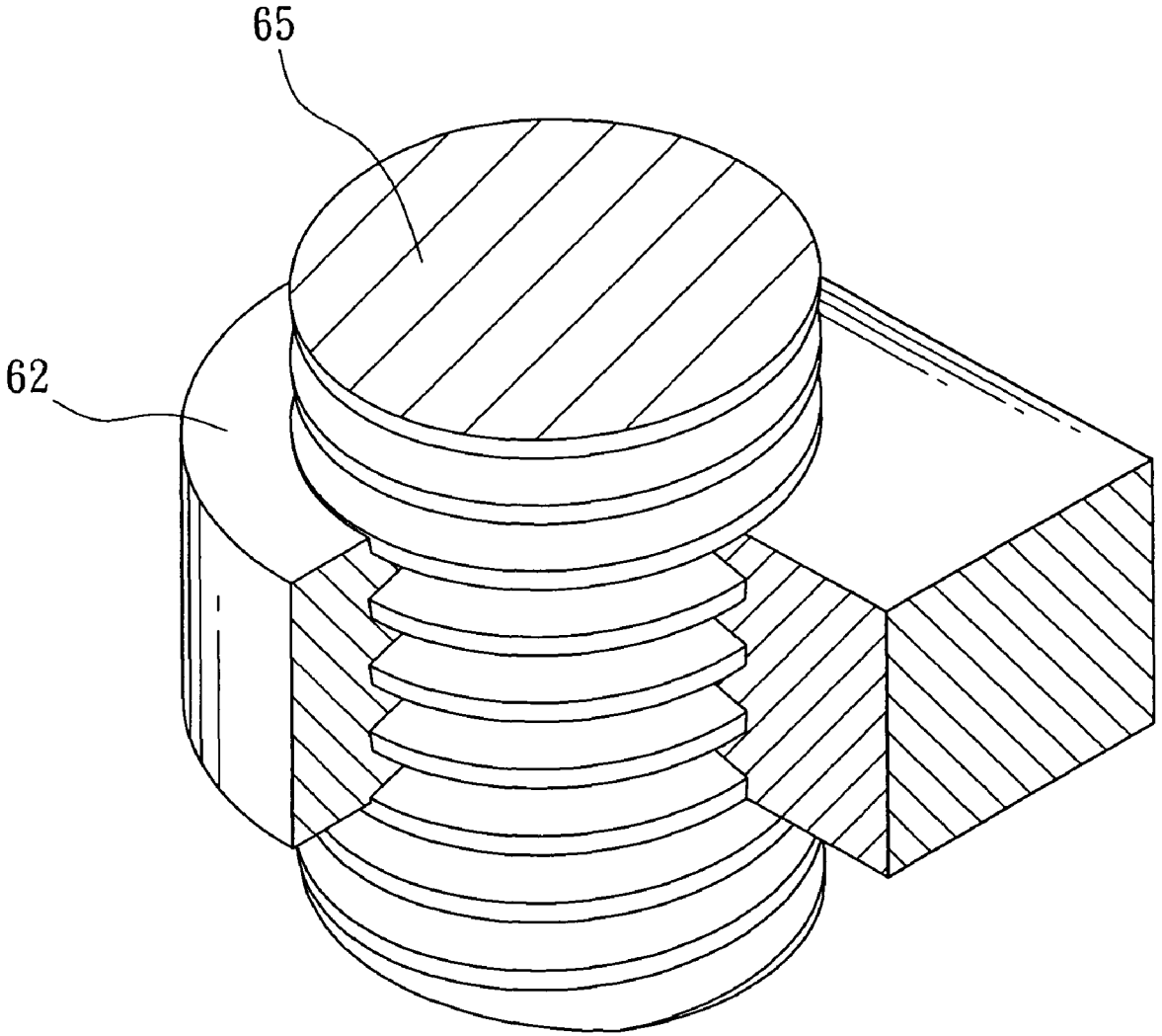
FIG. 8 is a cross sectional diagram of a screw and a bush of the angular adjusting mechanism according to the present invention.

As shown in FIGS. 7 and 8, since the rubbing mechanism is disposed in the swing seat 43 which includes a rotary shaft 42 axially mounted at the front end thereof and its rear end is retained by the angular adjusting mechanism for screwing with the bush 62 by way of the screw 65 of the swing seat 43, such that the rear end of the swing seat 43 is pulled by the screw 65, the bush 62 and the coupling member 61 to stably swing in the frame 41, and by using the threaded planes of the screwing coils of the screw 65 and the bush 62 to increase the support area and strength, the operation of the swing seat 43 and the rubbing mechanism may be stably supported.

Figure 9:
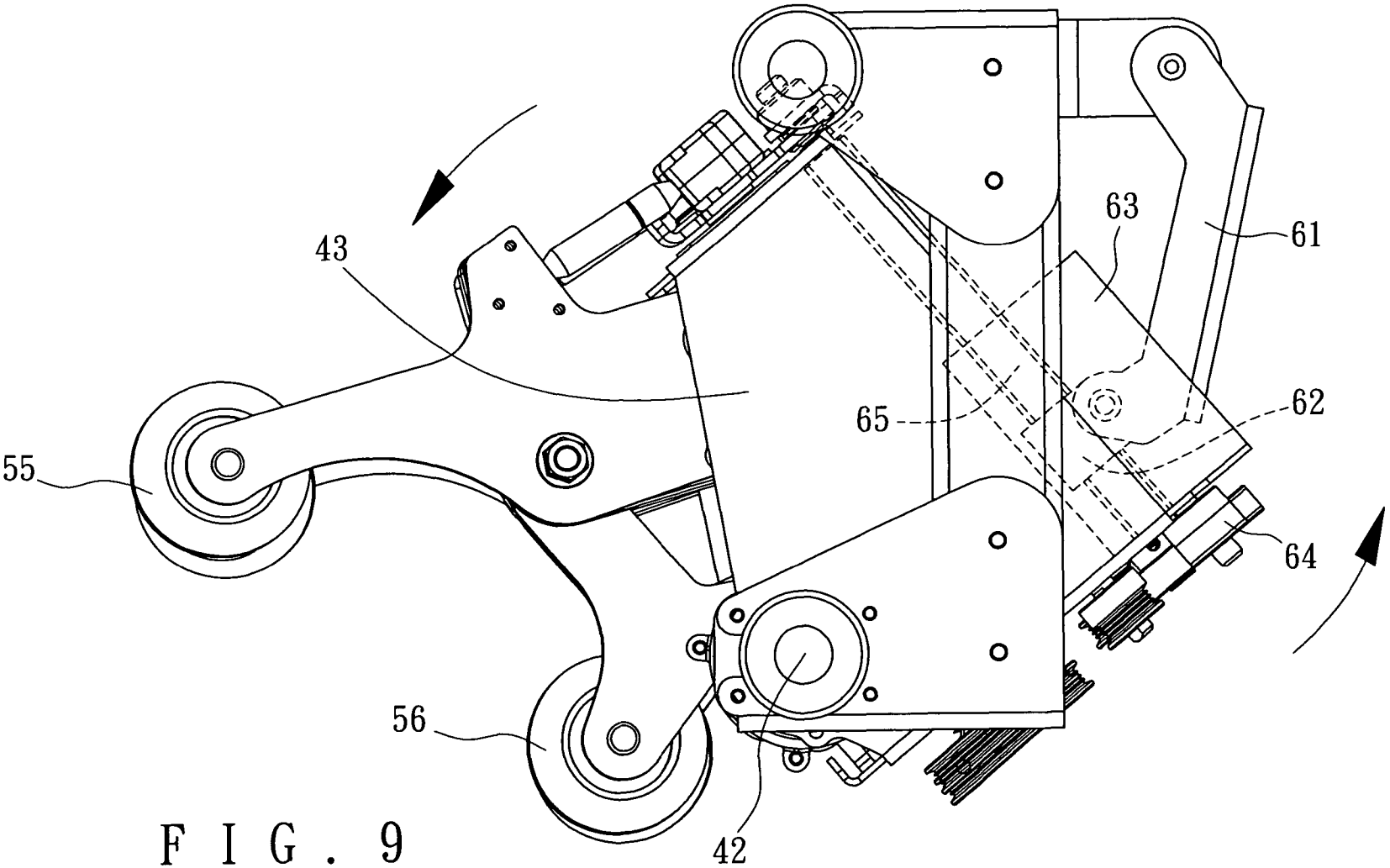
FIG. 9 is a side diagram illustrating the operational status of the angular adjusting mechanism according to the present invention.

With reference to FIGS. 8 and 9, while the angular adjusting mechanism extends forward to a proper position, the motor 63 is controlled to drive the pulley set 64 for urging the rotation of the screw 65, the screw 65 may displace upwardly along the bush 62. Because the bush 62 is pivotally connected onto the coupling member 61 to which a frame 41 is axially coupled so that the bush 62 and the coupling member 61 may adjustably swing with the angle of the screw 65. Further, as the screw 65 displaces upwardly along the bush 62, it may pull the rear end of the swing seat 43 to swing upwardly, so that the rotary shaft 42 becomes the fulcrum of the swing seat 43 to swing forward and backward, hence the rubbing mechanism swings forward to adjust the swing angle of the upper and lower massage rollers 55 and 56 so that the upper massage roller 55 extends and swings forward for having the massage operation. After adjusting the swing angle of the upper and lower massage rollers 55 and 56, by means of the threaded planes of the thread coils of the screw 65 and the bush 62, the support area and strength of the rubbing mechanism may be increased for improving its stable operation.

The invention is not limited to the above embodiment but various modifications thereof may be made. It will be understood by those skilled in the art that various changes in form and detail may made without departing from the scope and spirit of the present invention.

What is claimed is:

1. An angular adjusting mechanism for use in a massage device of a massage machine comprising:

a frame which comprises a rotary shaft axially disposed thereon;

a coupling member which is axially fixed at a rear portion of said frame, and comprises a bush pivotally mounted at said frame; and a swing seat axially mounted on said frame, and comprises:

a rubbing mechanism comprising a first motor for driving said rotary shaft to rotate;

a transmitting assembly;

a rubbing shank coupled with said transmitting assembly;

two swing arms pivotally affixed to two ends of said rubbing shank respectively, wherein each of said swing arms comprises an upper and a lower massage rollers attached at a front end thereof;

a second motor mounted in said frame;

a screw vertically provided on said swing seat; and a pulley set operatively coupled between said second motor and said screw for driving said screw to displace vertically, wherein an end of said screw is arranged to screw with said bush for said vertical displacement along said bush, such that during a rotation of said screw, said screw is arranged to vertically displace along said bush and actuate said swing seat to axially rotate along said frame for adjusting a swing angle and increasing a support strength of said upper and lower massage rollers, wherein when said screw displaces upwardly along said bush, said screw pulls said rear end of said swing seat to swing upwardly, so that said rotary shaft becomes a fulcrum of said swing seat to swing forward and backward in a stable manner.

2. The angular adjusting mechanism, as recited in claim 1, wherein said rotary shaft is axially mounted at a front end of said swing seat, wherein a rear end of said swing seat is retained by said angular adjusting mechanism while said screw is for screwing with said bush, such that a rear end of said swing seat is pulled by said screw, said bush and said coupling member to stably swing in said frame.

3. The angular adjusting mechanism, as recited in claim 2, wherein said screw has a plurality of screwing coils to define a corresponding number of threaded planes for coupling with said bush.

* * * * *